US007482977B2

(12) United States Patent
Kuroda et al.

(10) Patent No.: US 7,482,977 B2
(45) Date of Patent: Jan. 27, 2009

(54) ANTENNA APPARATUS

(75) Inventors: Shinichi Kuroda, Tokyo (JP); Tomoya Yamaura, Tokyo (JP); Akira Iga, Kanagawa (JP); Katsumi Okayama, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/073,620

(22) Filed: Mar. 8, 2005

(65) Prior Publication Data

US 2005/0253756 A1 Nov. 17, 2005

(30) Foreign Application Priority Data

Mar. 26, 2004 (JP) ..... 2004-091968

(51) Int. Cl.
*H01Q 1/38* (2006.01)
*H01Q 1/00* (2006.01)

(52) U.S. Cl. ..... 343/700 MS; 343/787

(58) Field of Classification Search ..... 343/700 MS, 343/702, 846, 787
See application file for complete search history.

(56) References Cited

U.S. PATENT DOCUMENTS 5,327,148 A * 7/1994 How et al. ..... 343/700 MS
5,593,612 A * 1/1997 Lubitz ..... 252/62.56
6,072,434 A * 6/2000 Papatheodorou ..... 343/700 MS
6,788,257 B2 * 9/2004 Fang et al. ..... 343/700 MS
6,791,496 B1 * 9/2004 Killen et al. ..... 343/700 MS

FOREIGN PATENT DOCUMENTS

| | | |
|---|---|---|
| JP | 61-189704 | 8/1986 |
| JP | 5-152830 | 6/1993 |
| JP | 2000-269731 | 9/2000 |
| JP | 2001-257522 | 9/2001 |
| JP | 2003-277135 | 10/2003 |

* cited by examiner

*Primary Examiner*—Shih-Chao Chen
(74) *Attorney, Agent, or Firm*—Oblon, Spivak, McClelland, Maier & Neustadt, P.C.

(57) ABSTRACT

Disclosed is a flat-type antenna apparatus which has a radiating conductor and a reference conductor disposed opposite to each other and performs feeding between the radiating conductor and the reference conductor at a position offset from the center of the radiating conductor center. The antenna includes: an insulative material layer which has relative magnetic permeability greater than 1 and is placed in a gap between the radiating conductor and the reference conductor; and a short-circuiting conductor which is disposed at a position to suppress unintended excitation and enables electric conduction between the radiating conductor and the reference conductor.

10 Claims, 7 Drawing Sheets

εr=1,μr=10,σ=0,l=20mm,L=50mm,h=4mm

NO SHORT-CIRCUITING CONDUCTOR PLATE PROVIDED

SHORT-CIRCUITING CONDUCTOR PLATE PROVIDED

εr=1,μr10,σ=0,l=20mm,L=50mm,h=4mm l=26mm,L=50mm,h=4mm

ANTENNA APPARATUS

CROSS REFERENCES TO RELATED APPLICATIONS

The present invention contains subject matter related to Japanese Patent Application JP 2004-091968 filed in the Japanese Patent Office on Mar. 26, 2004, the entire contents of which being incorporated herein by reference.

BACKGROUND OF THE INVENTION

The present invention relates to an antenna apparatus used to send and receive radio signals. Specifically, the present invention relates to an ultra wide band, small-size antenna apparatus capable of being applied to a wireless communication system which uses ultra wide band frequency bands such as ultra wide band communication for transmission and reception.

In more detail, the present invention relates to an antenna apparatus according to the patch antenna scheme configured by disposing a radiating conductor and a reference conductor (ground conductor) opposite to each other through an intermediate of insulative substance. Furthermore specifically, the present invention relates to a thin microstrip patch antenna having unidirectivity in a wide band.

In recent years, there is an increasing demand for wireless LAN systems in accordance with their increased processing speeds and reduced prices. Today, especially, introduction of a personal area network (PAN) is taken into consideration for the sake of information communication by constituting a small-scale wireless network between a plurality of electronic devices around a person. For example, there are provided different wireless communication systems using frequency bands such as 2.4 GHz and 5 GHz bands that need not be licensed by governing legal authorities.

Recently, particular attention is paid to "ultra wide band (UWB) communication" as a wireless system for short-distance, ultra-high speed transmission. The UWB communication is expected to be commercially available. The UWB communication system is designed for wireless communication to send and receive data by diffusing it to an ultra-wide frequency band from 3 GHz to 10 GHz, for example. Presently, the IEEE802.15.3 working group and the like are discussing access control systems for the ultra wide band communication.

Wireless communication including wireless LAN uses antennas for information transmission. Various types of antennas are available. In particular, wide band antennas can be used for the UWB communication to send and receive data by diffusing it to an ultra-wide frequency band. Small antennas contribute to miniaturization and light weight of wireless devices.

For example, a microstrip patch antenna is known as a thin antenna. That is, this antenna apparatus is configured by disposing a radiating conductor and a reference conductor opposite to each other through an intermediate of insulative substance. Generally, the radiating conductor is shaped to be rectangle or circular, although not specifically specified. The insulative substance is inserted between the radiating conductor and the reference conductor and is as thin as approximately one tenth of a wireless frequency wavelength or smaller. Accordingly, the microstrip patch antenna can be configured to be very thin. In addition, the microstrip patch antenna can be relatively easily manufactured by etching a double-sided copper clad insulative substrate. That is, the microstrip patch antenna is characterized by being relatively easily manufactured or being easily integrated with the circuit substrate.

FIG. 7 shows a configuration example of the microstrip patch antenna and its impedance matching circuit. The radiating conductor is shaped to be rectangle as shown in FIG. 7 or to be circular. A dielectric material is used for the insulative material and has the thickness of approximately one tenth of the wireless frequency wavelength, i.e., very thin. Actually, the microstrip patch antenna is often manufactured by etching a double-sided copper clad insulative substrate. Accordingly, the microstrip patch antenna is easily manufactured or easily integrated with the circuit substrate.

When the microstrip patch antenna having the above-mentioned construction is excited in the lowest mode (or $TM_{10}$-mode for the rectangular antenna), the antenna indicates the unidirectional radiation directivity approximately along the z-axis direction. There is available directional gain of approximately several dBi. Because of the excitation, the feeding point is provided at a position with a slight offset from the center. Adjusting the offset length makes it possible to align to 50 ohms.

The microstrip patch antenna itself uses a narrow operable band. The microstrip patch antenna is unsuitable for PAN systems and the like that use wide bands as operable bands. Depending on design parameters, a bandwidth smaller than or equal to VSWR2 exhibits the level of approximately several percentages. This drawback considerably has limited an applicable scope.

On the other hand, there is provided a wide-band antenna apparatus including a reference conductor and a radiating conductor connected by a feeding wire to supply power. The reference conductor and the radiating conductor are disposed so that at least parts thereof face to each other. An intermediate substance is placed between opposite parts of the reference conductor and the radiating conductor. At an operative wireless frequency, the intermediate substance indicates the conductivity approximating to greater than or equal to 0.1 and smaller than or equal to 10. Consequently, the antenna apparatus can provide the sufficient gain in a wide band. The reason follows. There is provided the substance having the conductivity approximating to greater than or equal to 0.1 and smaller than or equal to 10 between the reference conductor and the radiating conductor. The substance characterized by such conductivity can properly cause a signal leak between the reference conductor and the radiating conductor (e.g., see patent document 1).

Further, there is provided a thin wide-band antenna apparatus including a reference conductor and a radiating conductor connected by a feeding wire to supply power. The reference conductor and the radiating conductor are disposed parallel and opposite to each other near a pole. A magnetic material is placed between the reference conductor and the radiating conductor opposite to each other. At an operative wireless frequency, the magnetic material has relative magnetic permeability greater than 1 and approximately smaller than or equal to 8. Consequently, the antenna apparatus can provide the sufficient gain in a wide band (see Japanese Patent Application Laid-Open No. 304115/2003).

FIG. 8 shows results of simulating VSWR characteristics to exemplify comparison between operative bandwidths using a dielectric material and a magnetic material as insulative materials placed between the reference conductor and the radiating conductor opposite to each other. The bandwidths are compared by appropriately adjusting the relative permittivity or the relative magnetic permeability so as to keep the same antenna size. When the dielectric material with relative permittivity 3 is used, the operative bandwidth indicates 6.5% (VSWR of less than 2.5). When the magnetic material with relative magnetic permeability 3.6 used, the bandwidth indicates as high as 21.2%.

When the magnetic material is used as an intermediate, the impedance matching may be difficult by simply adjusting the offset length at the feeding point. Such case can be solved by using an impedance matching circuit as shown on the right of FIG. 7, for example.

SUMMARY OF THE INVENTION

When the magnetic material is used to construct the microstrip patch antenna, however, the bandwidth expands to cause a side effect of making effects from unexpected modes not negligible. This is because the modes operate in a wide band and easily overlap with each other. For this reason, the lowest and highest frequencies in the operative band gradually exhibit components to excite unexpected mode immediately before and after the band. These components may obstruct an originally intended radiation pattern.

Presently available magnetic materials indicate the relative permittivity set to a value greater than or equal to 1, never set to 1. (In most cases, the magnetic materials indicate the relative permittivity set to a value greater than or equal to the relative magnetic permeability.) That is, the magnetic material also features the characteristic as dielectric material. When such insulative material is used as an intermediate, its dielectric property may degrade the effect of expanding the bandwidth (though this effect primarily should be demonstrated due to the permeability).

Presently, there is a limitation of up to approximately several hundreds megahertz of operations on practically engineered oxide magnetic materials for high frequencies. This is called the "Snoek's limit" for spinel ferrite. In most cases, the high permeability cannot be expected in a region exceeding the frequency. On the other hand, the microstrip patch antenna is actually expected to be used in a microwave band (i.e., a GHz band) or higher.

Therefore, it is necessary to use new magnetic materials for microwave bands in order to provide a practically significant magnetic-material microstrip patch antenna. For this purpose, it is mandatory to select compositions which feature as low permittivity as possible in consideration for the above-mentioned problem of degrading the effect of expanding the bandwidth.

Under the circumstance, the present invention addresses the foregoing problem to provide an antenna apparatus excellent in the microstrip patch antenna construction provided by disposing a radiating conductor and a reference conductor opposite to each other using an intermediate including a magnetic material as insulative substance.

The present invention also provides an excellent thin microstrip patch antenna having unidirectivity in a wide band.

The present invention has been made in consideration of the foregoing. According to a first embodiment of the present invention, there is provided a flat-type antenna apparatus which has a radiating conductor and a reference conductor disposed opposite to each other and performs feeding between the radiating conductor and the reference conductor at a position offset from the center of the radiating conductor center, the antenna including:

an insulative material layer which has relative magnetic permeability greater than 1 and is placed in a gap between the radiating conductor and the reference conductor; and a short-circuiting conductor which is disposed at a position to suppress unintended excitation and enables electric conduction between the radiating conductor and the reference conductor.

The antenna apparatus according to the first embodiment of the present invention uses an insulative material including a magnetic material (relative magnetic permeability>1) to provide wide band operations. Further, the antenna apparatus is constructed to appropriately dispose a short-circuiting conductor at a position to suppress excitation of an unneeded high-order mode. The short-circuiting conductor is used for electric conduction between a radiating conductor and a reference conductor.

According to the example in FIG. 1, for example, the short-circuiting conductors are partially provided along the y-axis (x=0). Forcibly zeroing an inter-plate voltage at this point makes it difficult to enable an unnecessary high-order mode. Since the y-axis originally shows zero potentials in an intended lowest-order mode ($TM_{10}$-mode), the excitation is not suppressed. That is, it is possible to suppress excitation of only unnecessary high-order modes without changing the intended mode. The inventors consider that this treatment is very significant for the magnetic-material microstrip patch antenna featuring wide band characteristics.

According to a second embodiment of the present invention, there is provided a flat-type antenna apparatus which has a radiating conductor and a reference conductor disposed opposite to each other and performs feeding between the radiating conductor and the reference conductor at a position offset from the center of the radiating conductor center, the antenna including:

an intermediate layer including a plurality of layers such as an insulative material layer and an empty layer in a gap between the radiating conductor and the reference conductor, wherein the insulative material layer has relative permittivity and relative magnetic permeability both greater than 1.

The antenna apparatus according to the second embodiment of the present invention uses a magnetic material (relative magnetic permeability>1) as an insulative material for wide band operations. However, the insulative material does not completely fill the gap between the radiating conductor and the reference conductor. A multi-layer structure is used to appropriately insert empty layers (with the relative permittivity and the relative magnetic permeability both set to 1) in-between.

The present invention takes into consideration the fact that the dielectric property is also contained in the magnetic material used as an insulative material and degrades the effect of expanding the bandwidth. According to the embodiment of the present invention, an empty layer is inserted into insulative material layers. This ensures an effect of providing relative permittivity $\in_r$ approximate to 1 for the entire intermediate layer between the radiating conductor and the reference conductor. It is preferable to configure the empty layer so that the permittivity becomes discontinuous in the electric flux direction and the permeability becomes continuous in the magnetic flux direction. In this case, the permittivity can be decreased by preventing a decrease in the permeability for the entire intermediate layer.

The insulative material layer can, comprise hexagonal ferrite. The hexagonal ferrite can be an oxide magnetic material including; a Y-type ferrite compound represented by general formula $Ba_2Me^1{}_2Fe_{12}O_{22}$; a Z-type ferrite compound represented by general formula $Ba_3Me^1{}_2Fe_{24}O_{41}$; or an M-type ferrite compound represented by general formula $BaMe^2{}_xFe_{(12-x)}O_{19}$. (In these formulas, $Me^1$ is appropriately selected from one or more of $Ni^{2+}$, $Zn^{2+}$, $Mn^{2+}$, $Mg^{2+}$, $Cu^{2+}$, $Fe^{2+}$, and $Co^{2+}$ to adjust composition. $Me^2$ is appropriately selected from one or more of $Al^{3+}$, $Cr^{3+}$, $Sc^{3+}$, and $In^{3+}$ to adjust composition, or is a mixture of the same amount of ($Ti^{4+}$, $Sn^{4+}$, $Zn^{4+}$) and $Me^1$.) In order to maintain high permeability and low permittivity, the present invention adjusts compositions basically containing divalent metal ion or trivalent metal ion. This makes it possible to provide properties suitable for the magnetic-material microstrip patch antenna for microwave bands.

When an insulative intermediate is provided in a gap between the radiating conductor and the reference conductor, excess permittivity of the insulative intermediate damages the feature as the magnetic-material antenna. In order to decrease the permittivity, it is also possible to use a complex material as the insulative material layer. The complex material comprises a mixture of the oxide magnetic materials as pulverized materials having the above-mentioned composition and resin (relative permittivity set to 2 or 3).

The present invention can provide an antenna apparatus excellent in the microstrip patch antenna construction provided by disposing a radiating conductor and a reference conductor opposite to each other using an intermediate including a magnetic material as insulative substance.

The present invention solves the problem concerning a side effect of expanding the bandwidth when the magnetic material is used as insulative substance for an intermediate. The present invention can provide an excellent thin microstrip patch antenna having unidirectivity in a wide band. The microstrip patch antenna according to the embodiment of the present invention can be suitably applied to ultra wide band-wireless communication systems that use ultra-wide frequency bands for transmission and reception, for example.

These and other objects and novel features of the invention may be readily ascertained by referring to the following description and appended drawings.

DETAILED DESCRIPTION OF THE PREFERRED EMBODIMENTS

Embodiments of the present invention will be described in further detail with reference to the accompanying drawings.

Figure 1:
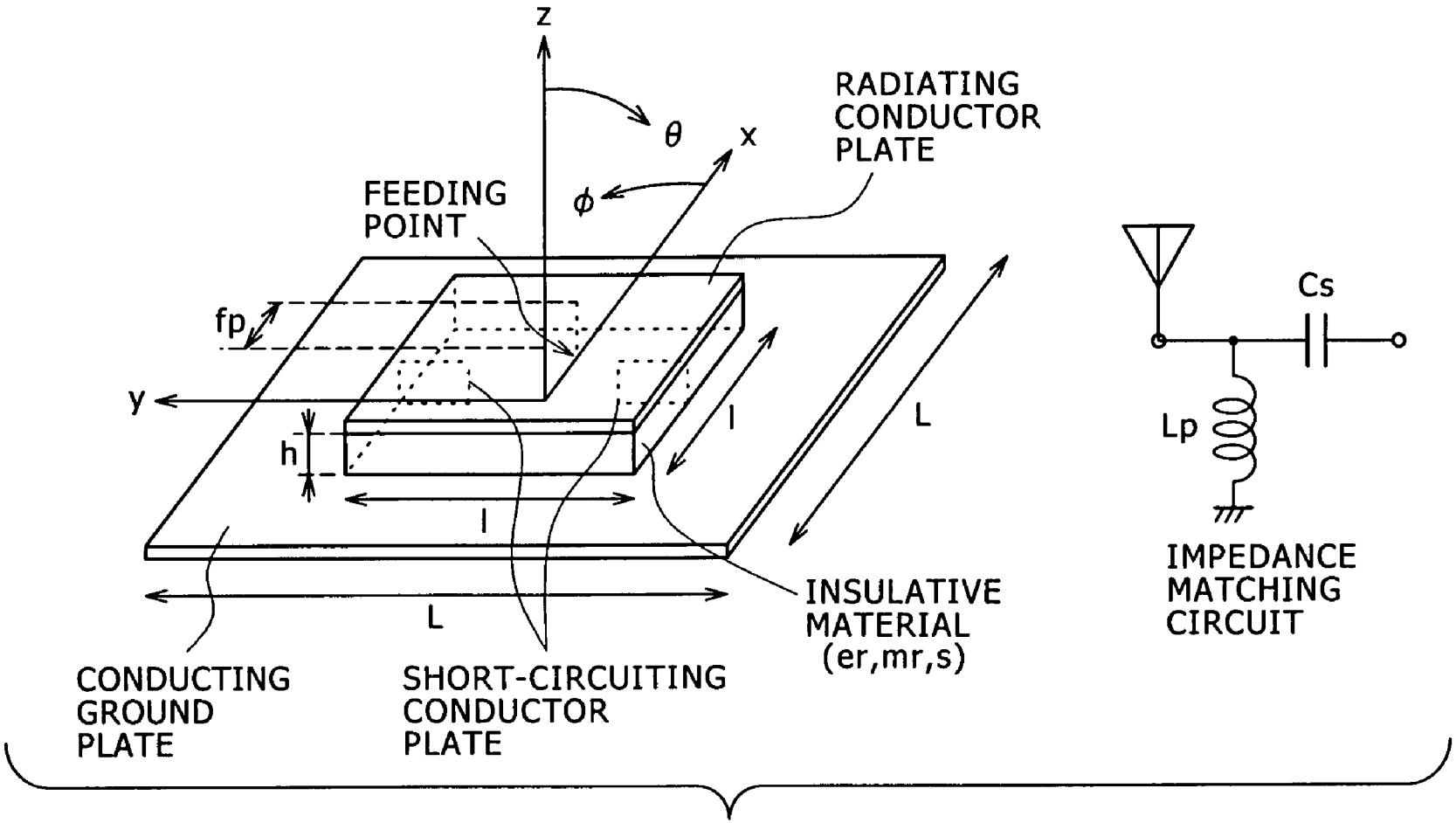
FIG. 1 schematically shows the configuration of a microstrip patch antenna according to a first embodiment of the present invention.

FIG. 1 schematically shows the configuration of a microstrip patch antenna according to a first embodiment of the present invention;

As shown in FIG. 1, the microstrip patch antenna is a flat antenna including a radiating conductor and a reference conductor disposed opposite to each other using an intermediate including substance having appropriate insulation. In FIG. 1, the origin of the xy coordinate system is placed at the center of the radiating conductor. The z-axis is settled along a direction orthogonal to the xy plane. For excitation, a feeding point is provided at a position with offset fp from the center of the radiating conductor, i.e., the xy origin.

The embodiment uses a magnetic material (relative magnetic permeability>1) as an insulative material for wide band operations. The embodiment is configured to appropriately dispose a short-circuiting conductor at a position to suppress excitation of an unnecessary high-order mode. The short-circuiting conductor is used for electric conduction between the radiating conductor and the reference conductor.

According to the example in FIG. 1, for example, the short-circuiting conductors are partially provided along the y-axis (x=0). Forcibly zeroing an inter-plate voltage at this point makes it difficult to enable an unnecessary high-order mode. Since the y-axis originally shows zero potentials in an intended lowest-order mode ($TM_{10}$-mode), the excitation is not suppressed. That is, it is possible to suppress excitation of only unnecessary high-order modes without changing the intended mode. The inventors consider that this treatment is very significant for the magnetic-material microstrip patch antenna featuring wide band characteristics.

Figure 2:
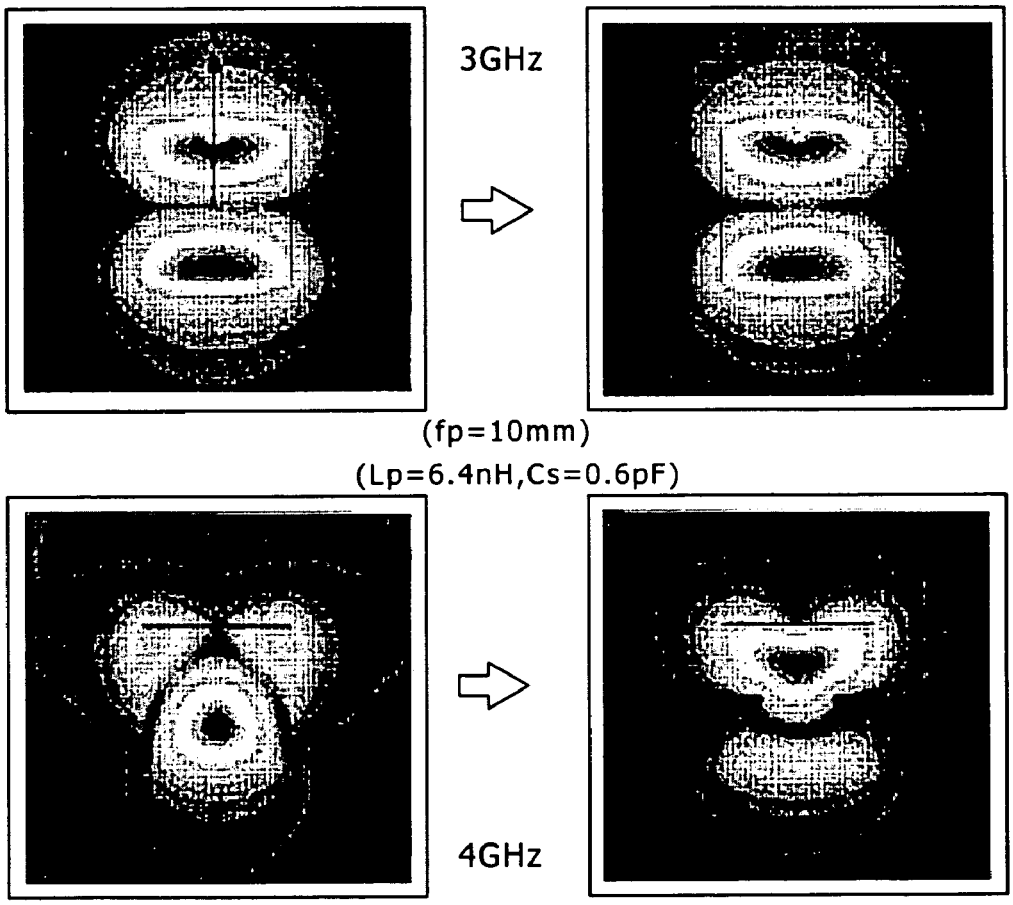
FIG. 2 exemplifies characteristics of the microstrip patch antenna according to the embodiment of the present invention using results of simulating internal electric field distribution along a z-axis direction.
Figure 8:
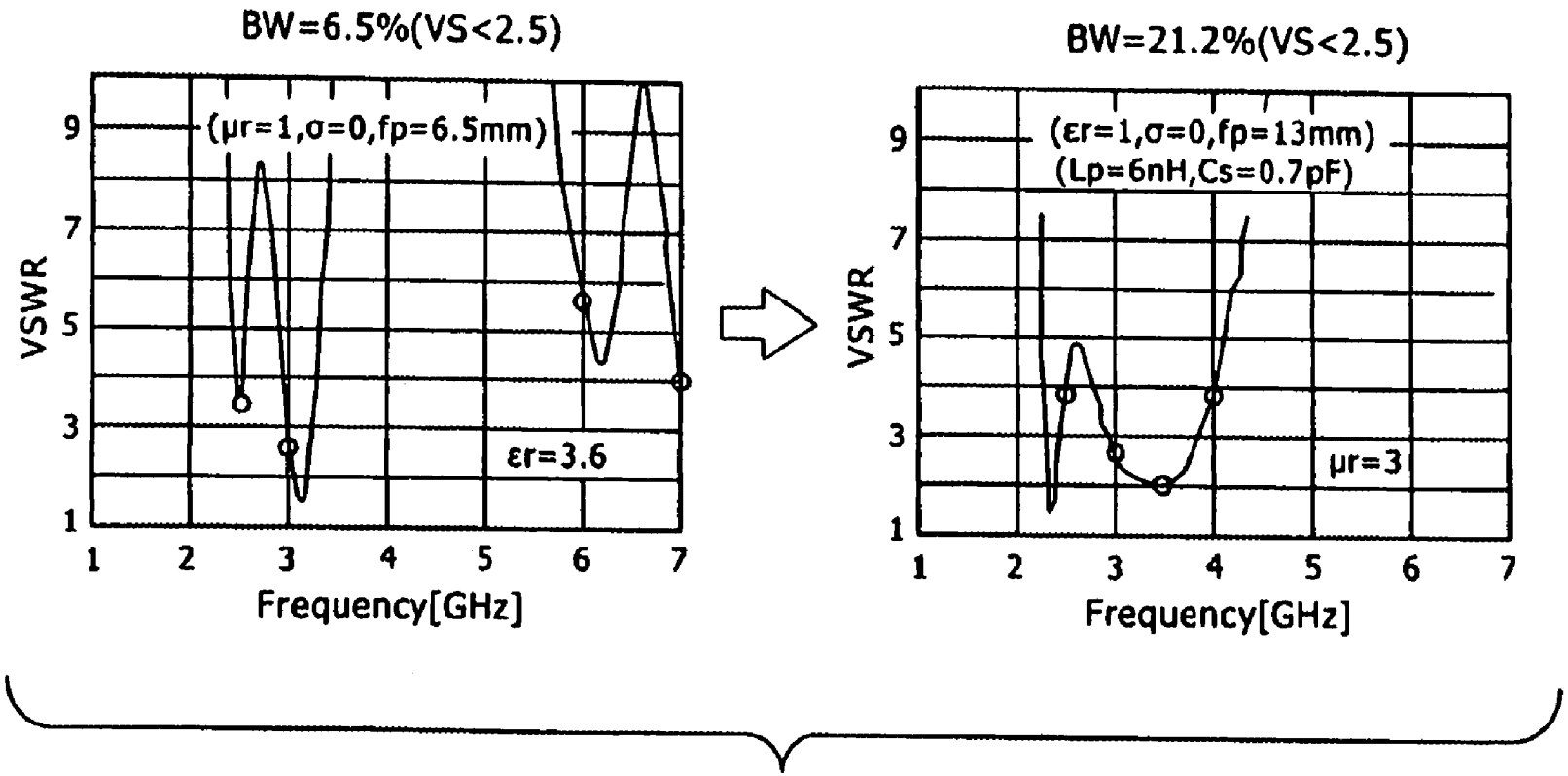
RELATED ART FIG. 8
FIG. 8 shows results of simulating VSWR characteristics to exemplify comparison between operative bandwidths using a dielectric material and a magnetic material as insulative materials placed between the reference conductor and the radiating conductor opposite to each other.

FIG. 2 exemplifies characteristics of the microstrip patch antenna having the short-circuiting conductor according to the embodiment using results of simulating internal electric field distribution along a z-axis direction. For comparison, the simulation results in FIG. 2 are represented as follows. The left side signifies "no short-circuiting conductor provided." The right side signifies "short-circuiting conductor provided." The upper part uses an operative frequency of 3 GHz. The lower part uses an operative frequency of 4 GHz. Like the characteristic example in FIG. 8, the example in FIG. 2 also uses parameters ($\epsilon_r$=1, $\mu_r$=10, $\sigma$=0, 1=20 mm, L=50 mm, h=4 mm) operative in the lowest-order mode approximately at 3 to 4 GHz. A square at the center of each plot corresponds to the radiating conductor.

The result of the 3 GHz frequency indicates a minimum electric field intensity (almost zero inter-plate voltages) on the y-axis independently of whether or not the short-circuiting conductor is provided. The result also indicates an occurrence of electric field distribution for the known $TM_{10}$-mode so that the electric field intensity increases toward the upper and lower bounds. Since the inter-plate voltage on the y-axis is almost zero, the prescribed distribution is maintained independently of whether or not the short-circuiting conductor is provided.

The result of the 4 GHz frequency indicates that the distribution for the $TM_{10}$-mode begins to be deformed and an effect of the high-order mode is remarkable. When no short-circuiting conductor is used, the high-field region is divided into three portions, hardly leaving traces of the $TM_{10}$-mode. When the short-circuiting conductor is used, by contrast, the high-field region, though deformed, is divided into the upper and lower bounds, slightly maintaining traces of the $TM_{10}$-mode. This is because provision of the short-circuiting conductor suppresses unintended high-order modes. Originally, the unintended high-order modes indicate no inter-plate voltages at the position where the short-circuiting conductor is provided. It is considered forcibly short-circuiting that position makes the excitation difficult.

Figure 3:
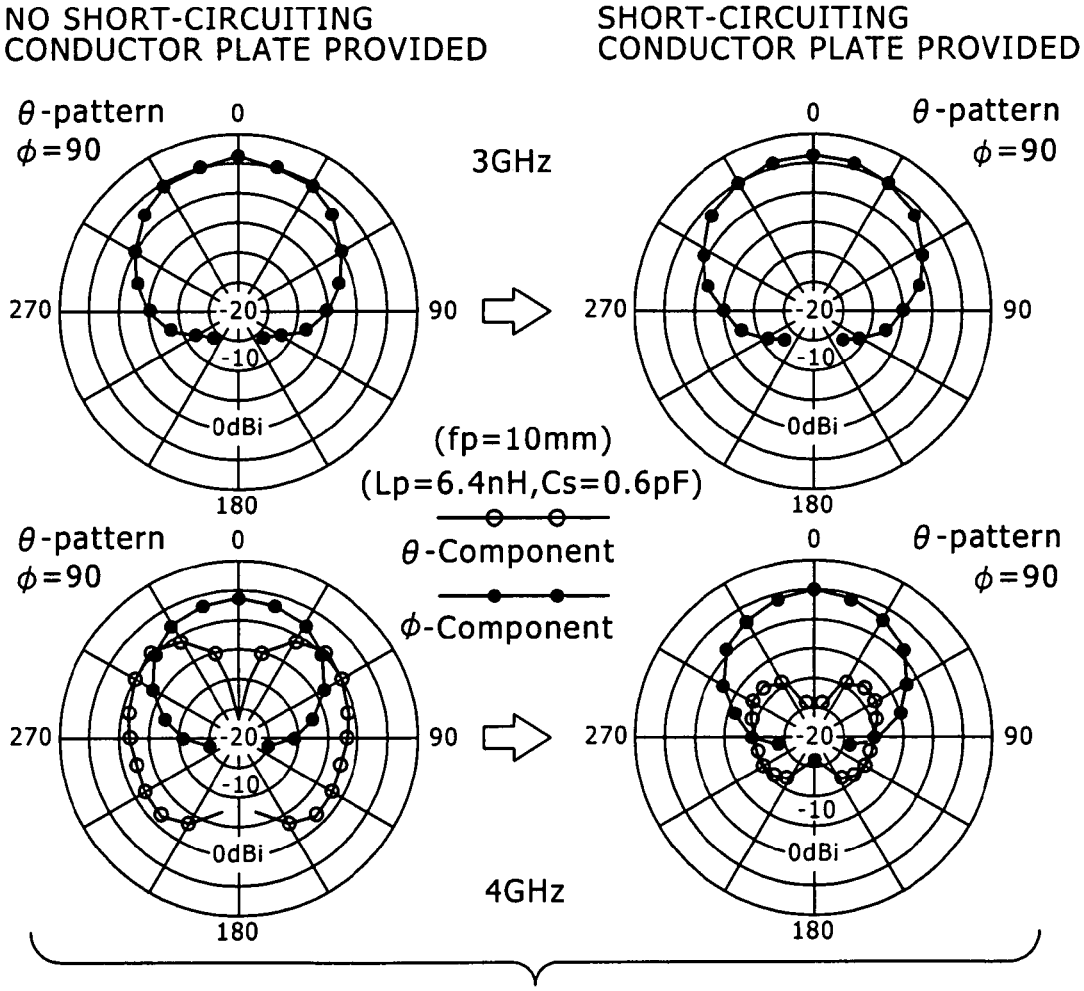
FIG. 3 exemplifies characteristics of the microstrip patch antenna according to the embodiment of the present invention using results of simulating radiation patterns.

FIG. 3 exemplifies characteristics of the microstrip patch antenna according to the embodiment of the present invention using results of simulating radiation patterns. The simulation results in FIG. 3 represent comparison of cases where the short-circuiting conductor is provided and not. The upper part uses an operative frequency of 3 GHz. The lower part uses an operative frequency of 4 GHz. Like the characteristic example in FIG. 8, the example in FIG. 2 also uses parameters ($\in_r$=1, $\mu_r$=10, $\sigma$=0, 1=20 mm, L=50 mm, h=4 mm) operative in the lowest-order mode approximately at 3 to 4 GHz. A measurement plane is selected to satisfy $\phi$=90 degrees (y-z plane). That is, the measurement plane is selected so that intended lowest-order mode components appear as $\phi$ vector components and immediately succeeding high-order mode components appear as $\theta$ vector components.

The result of the 3 GHz frequency indicates only $\phi$ vector components in the lowest-order mode independently of whether or not the short-circuiting conductor is provided. The unidirectivity intrinsic to the lowest-order mode is obtained along the direction (z-axis direction) of $\theta$=0 degrees. The simulation result in FIG. 3 shows the peak gain of 5.8 dBi along this direction.

The result of the 4 GHz frequency indicates occurrence of not only $\phi$ vector components in the lowest-order mode, but also $\theta$ vector components in the high-order mode. When no short-circuiting conductor is provided, the high-order mode components appear remarkably to distribute the electric power to unintended directions. As a result, the peak gain for the $\phi$ vector components drops down to as low as 3.0 dBi. When the short-circuiting conductor is provided, by contrast, high-order mode components are suppressed considerably. The peak gain for intended $\phi$ vector components indicates 4.7 dBi. This means a relatively small loss. That is, provision of the short-circuiting conductor suppresses the electric power radiated to unintended directions and accordingly improves the electric power in the intended direction. It is considered that the results represent the above-mentioned difference in electric field distributions.

Figure 4:
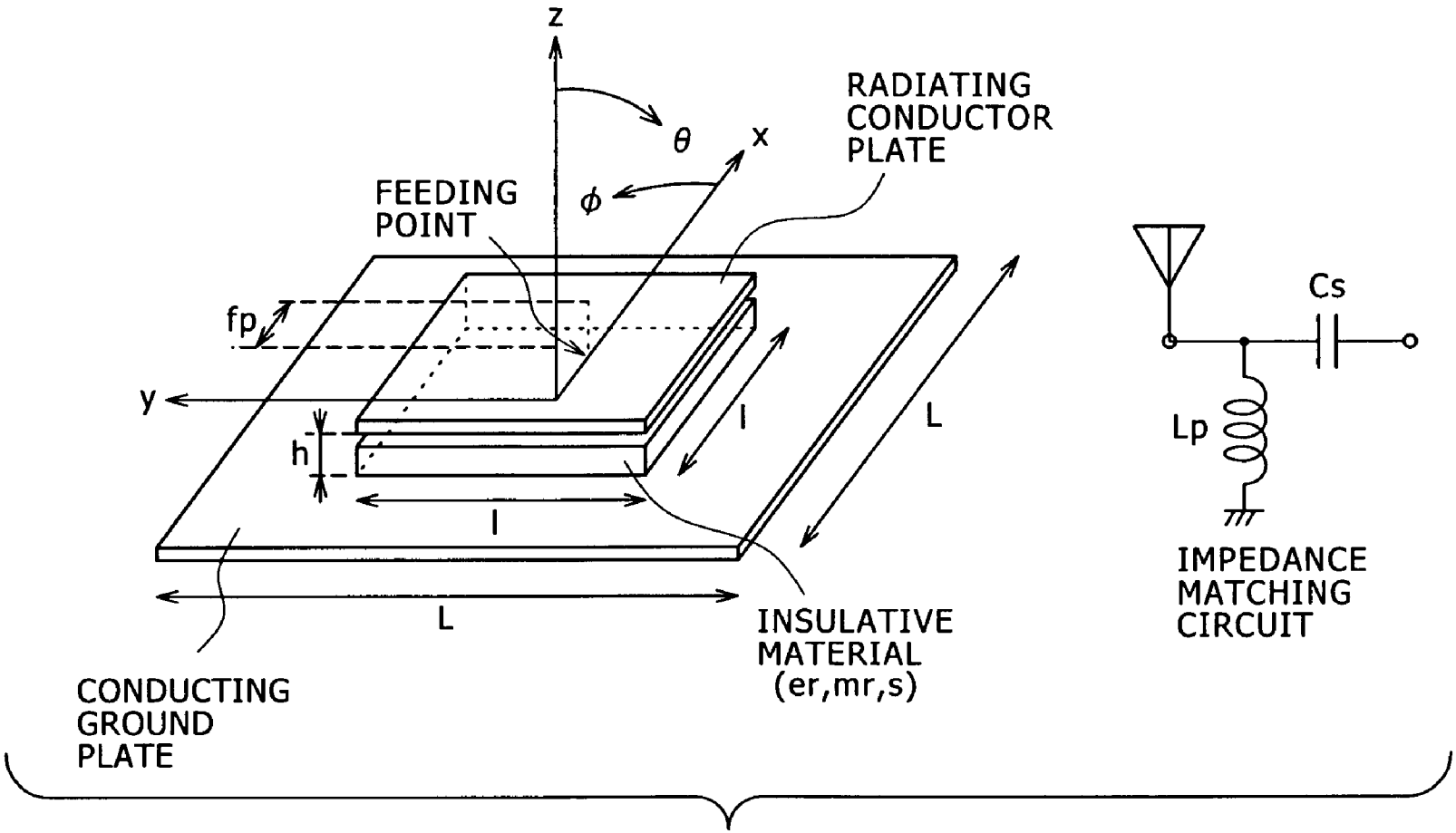
FIG. 4 schematically shows the configuration of the microstrip patch antenna according to another embodiment of the present invention.

FIG. 4 schematically shows the configuration of the microstrip patch antenna according to another embodiment of the present invention.

As shown in FIG. 4, the microstrip patch antenna is a flat antenna including a radiating conductor and a reference conductor disposed opposite to each other using an intermediate including substance having appropriate insulation. In FIG. 1, the origin of the xy coordinate system is placed at the center of the radiating conductor. The z-axis is settled along a direction orthogonal to the xy plane. For excitation, a feeding point is provided at a position with offset fp from the center of the radiating conductor, i.e., the xy origin.

The embodiment uses a magnetic material (relative magnetic permeability>1) as an insulative material for wide band operations. However, the insulative material does not completely fill the gap between the radiating conductor and the reference conductor. A multi-layer structure is used to appropriately insert empty layers (with the relative permittivity and the relative magnetic permeability both set to 1) in-between.

The embodiment takes into consideration the fact that the dielectric property is also contained in the magnetic material used as an insulative material and degrades the effect of expanding the bandwidth. According to the embodiment, an empty layer is inserted into insulative material layers. This ensures an effect of providing relative permittivity $\in_r$ approximate to 1 for the entire intermediate layer between the radiating conductor and the reference conductor. It is preferable to configure the empty layer so that the permittivity becomes discontinuous in the electric flux direction and the permeability becomes continuous in the magnetic flux direction. In this case, the permittivity can be decreased by preventing a decrease in the permeability for the entire intermediate layer.

The example in FIG. 4 comprises one layer of insulative material and one empty layer. The multi-layer structure may be used to alternate these layers.

The embodiment is effective when using an intermediate including the magnetic material having the relative permittivity exceeding 1, i.e., the insulative material having permeability and dielectric property. When such insulative material is used for the antenna construction in the past, the dielectric property degrades the bandwidth expansion effect (that should be primarily demonstrated in accordance with the permeability).

Figure 5:
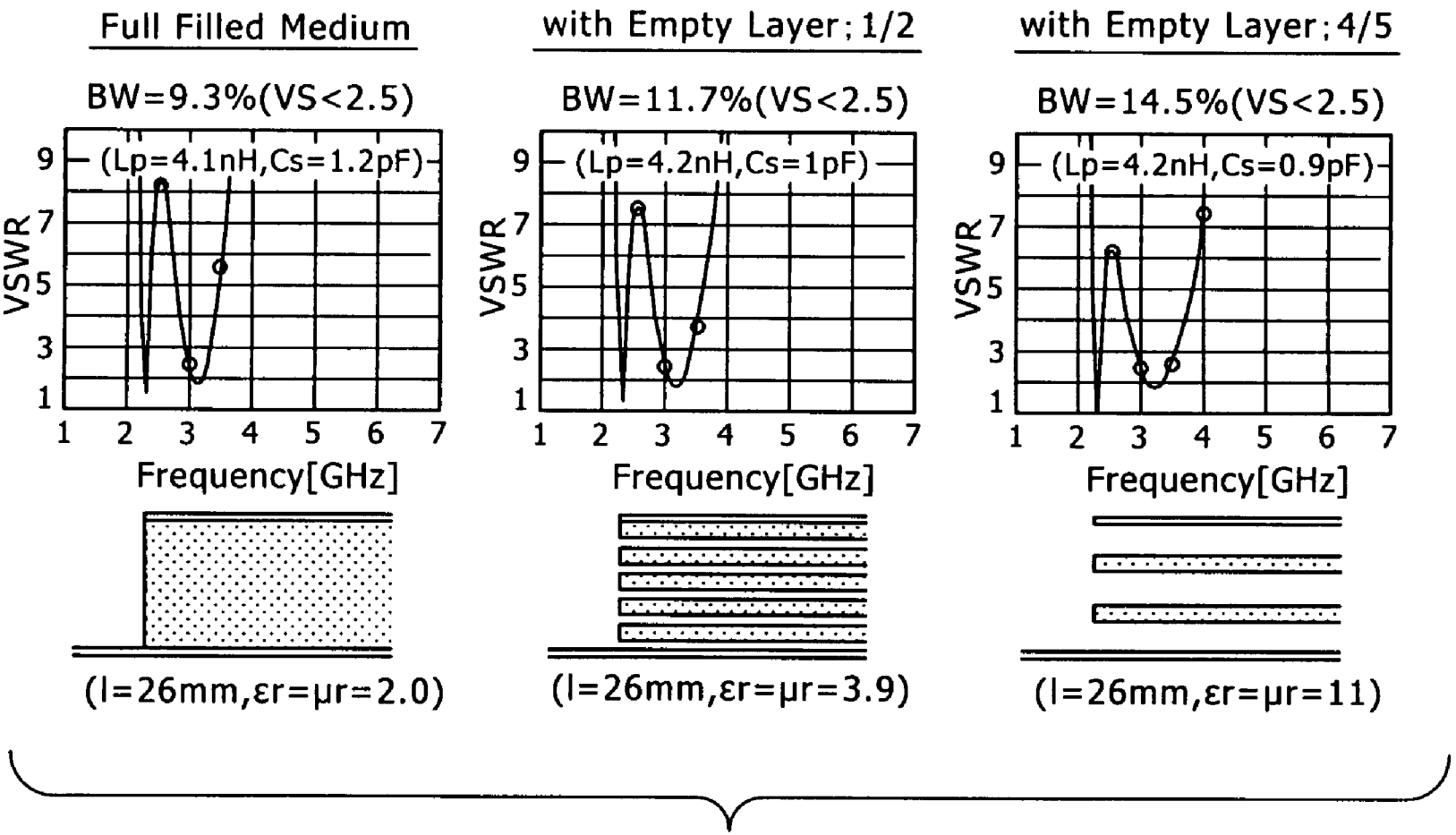
FIG. 5 shows operative bandwidths of the microstrip patch antenna as shown in FIG. 4 according to the embodiment of the present invention using results of simulating VSWR characteristics.

FIG. 5 shows comparison between operative bandwidths of microstrip patch antennas according to a construction example and the embodiment in the past. FIG. 5 represents the antennas' operative bandwidths using results of simulating VSWR characteristics. The radiating conductor is assumed to have the side length of 26 mm. The parameters are appropriately adjusted so that the operative band indicates the lower-bound frequency of 3 GHz under the restriction of relative permittivity=relative magnetic permeability.

The left end of FIG. 5 shows an operative bandwidth of the microstrip patch antenna according to the construction example in the past that completely fills the gap with the insulative material (having the relative permittivity and the relative magnetic permeability both set to 2). As shown in FIG. 5, the operative bandwidth indicates 9.3% (VSWR of less than 2.5). The bandwidth decreases compared to the pure magnetic material (having the relative permittivity set to 1 and the relative magnetic permeability set to 3.6) in FIG. 8. This indicates the effect of decreasing the bandwidth due to the dielectric property.

The center of FIG. 5 shows the operative bandwidth of the microstrip patch antenna according to the embodiment that inserts insulative materials and empty layers into a gap between the radiating conductor and the reference conductor. The empty layer is assumed to have the volume ratio of ½. The insulative material is assumed to have the relative permittivity and the relative magnetic permeability both set to 3.9. In this case, the bandwidth is restored to 11.7% as shown in FIG. 5. Since the empty layer is provided across the electric flux, it is considered that the effect of decreasing the dielectric property is superior to that of decreasing the permeability.

The right end of FIG. 5 shows the operative bandwidth of the microstrip patch antenna by increasing the volume ratio of empty layers inserted into the gap between the radiating conductor and the reference conductor. In this case, the bandwidth is further restored to 14.5% as shown in FIG. 5.

Figure 6:
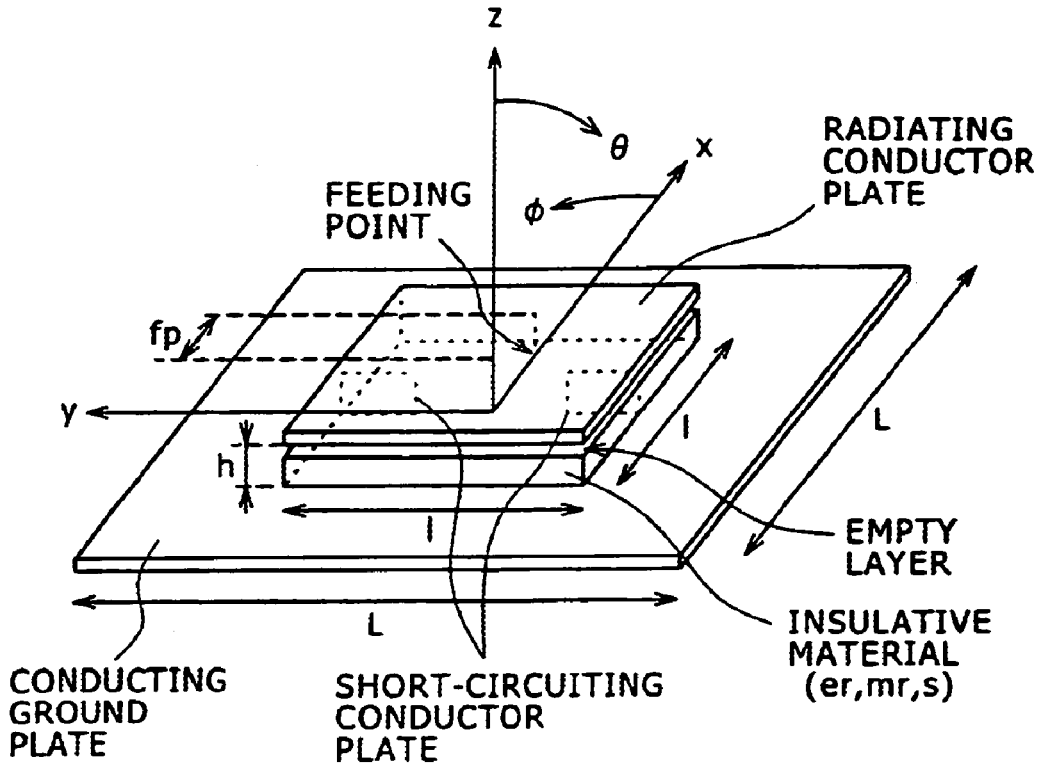
FIG. 6 exemplifies the configuration of a microstrip patch antenna constructed by combining the configuration of disposing the short-circuiting conductor in FIG. 1 at a position to suppress excitation of an unnecessary high-order mode with the configuration of placing a plurality of layers alternately including an insulative material layer and an empty layer in a gap between a radiating conductor and a reference conductor.
Figure 7:
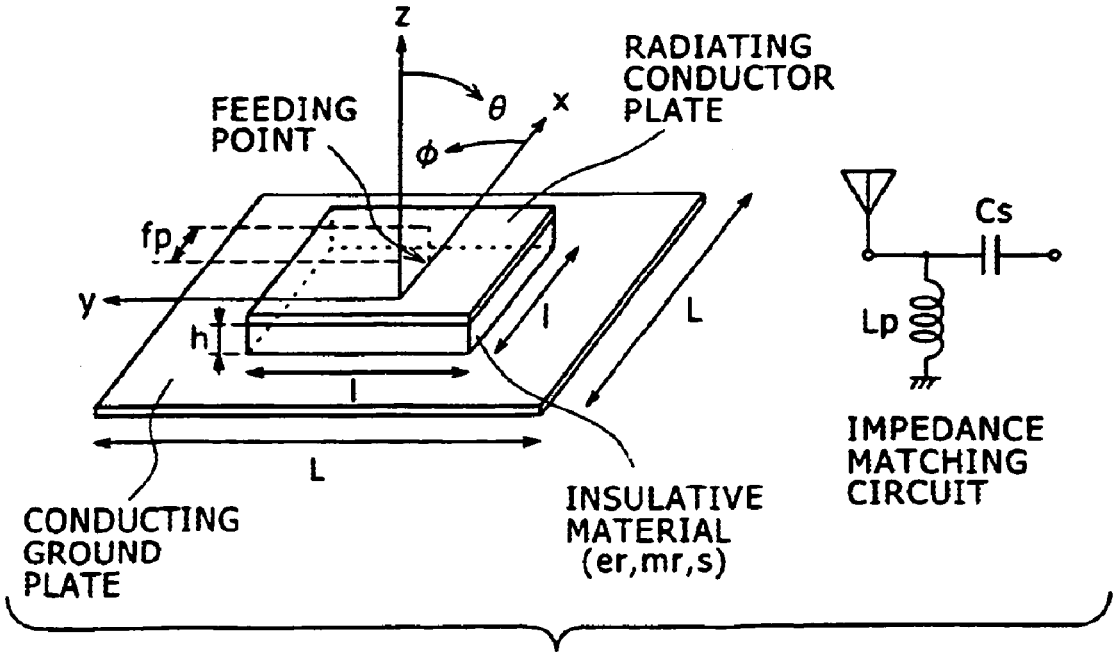
FIG. 7 RELATED ART
FIG. 7 exemplifies the configuration of a microstrip patch antenna and its impedance matching circuit (example in the past)

The above-mentioned microstrip patch antennas according to the embodiments of the present invention achieve the specific effects. Of course, these effects can be expected at the same time by using the embodiments together. FIG. 6 exemplifies the configuration of a microstrip patch antenna constructed by combining two constructions. According to one constitution (see FIG. 1), a flat antenna comprises a radiating conductor and a reference conductor opposite to each other with an intermediate made of a material having appropriate insulation in-between. A short-circuiting conductor is provided for electric conduction between the radiating conductor and the reference conductor at a position to suppress the excitation of unnecessary high-order modes. According to the other constitution (see FIG. 4), a gap between the radiating conductor and the reference conductor is formed to be a plurality of layers including alternating insulative material layers and empty layers.

Finally, the following describes the insulative intermediate inserted in the gap between the radiating conductor and the reference conductor according to the above-mentioned embodiments. The embodiment uses the magnetic material as an insulative material to achieve the effect of expanding the operative bandwidth. As mentioned above, oxide magnetic materials such as spinel ferrite are subject to the problem of "Snoek's limit" that high permeability cannot be expected in high frequency bands. To solve this problem, the embodiment uses the following oxide magnetic materials.

Y-type ferrite (a) $Zn_2Y$ ($Ba_2Me^1{}_2Fe_{12}O_{22}$)

(b) NiZnY ($Ba_3Me^1{}_2Fe_{24}O_{41}$)

M-type ferrite (c) BaM ($BaFe_{9.75}Sn_1Mn_{1.25}O_{19}$)

Basic compositions of these ferrites are publicized in "*Ferrites*" (Philips Technical Library (1959)) written by J. Smit and H. P. J. Wijn, for example. The present invention constitutes an insulative material layer of hexagonal ferrite. In order to maintain high permeability and low permittivity, the present invention adjusts compositions basically containing divalent metal ion or trivalent metal ion. This makes it possible to provide properties suitable for the magnetic-material microstrip patch antenna for microwave bands.

As mentioned above, it is apparent that excess permittivity of the insulative intermediate damages the feature as the magnetic-material antenna. In order to decrease the permittivity, it is also possible to use a complex material including a mixture of the above-mentioned composition and resin (relative permittivity set to 2 or 3). For example, the complex material is a resin complex including the above-mentioned oxide magnetic materials as pulverized materials complexed with known resins (ABS, PC, PS, phenol, epoxy, CP rubber, acrylic, and the like). There are also provided advantages of reducing the weight, preventing brittle fracture, improving the crash strength, enhancing the degree of freedom to design antenna shapes, and the like.

Generally, ferrites are manufactured by wet or dry process. The following describes the dry process to manufacture ferrite.

Raw material powders used are $BaCO_3$, $\alpha Fe_2O_3$, $Co_2O_3$, ZnO, and NiO. As starting materials, all the powders show the purity of 99% or more and are weighed in consideration for included impurities. The raw material $Fe_2O_3$ is appropriately adjusted within the range from 0.1% to 1% in consideration for mixture of abraded metal powders from a pot and balls in a ball mill to be described. The zinc oxide ZnO is appropriately adjusted within the range from 0.1% to 2% in consideration for evaporation of ZnO during baking at high temperatures. A small amount of $SiO_2$, CaO, and the like are added to improve the sintering property. A wet-type planetary ball mill is used to mix the powders after weighed to a specified composition. At this time, it is preferable to suitably use water, alcohol, trichloroethylene, and the like as the solvent. The embodiment uses ethyl alcohol. The embodiment suitably uses modes of carbonized substance and oxide as starting materials. Further, it may be preferable to use metal alkoxide, oxalate, organic metal complex, and the like.

The mixed slurry is dried and then is pelleted. The pellets are baked at 1000° through 1400° C. (optimal temperatures dependent on compositions) to yield a ferrite compound. The pellets are coarsely ground and then are finely ground using the ball mill in a wet manner. There is the following reason for once producing the ferrite compound and then grounding it. Since gas or evaporation components in the raw material react, it is necessary to alleviate adverse effects due to removal from the pellets.

After the fine grinding, the slurry is again pelleted and is finally baked. In consideration for an oxygen dissociation pressure, the baking is conducted in inert gas or optimum gas such as $N_2$. The resulting pellets have the density of approximately 99% or more and can almost approximate to the true density. The pellets are ground and sieved to provide a plurality of powder variations with different particle size distributions. The resulting powder is mixed with resin and is sheeted using a three-roll machine or a known sheet mixer. The resin used is ABS, PC, PPS, or the like. The ferrite powder filling amount is adjusted within the range between 30% and 60%. While the high filling provides an advantage of increasing the permeability, the permittivity also increases to deviate from the characteristic range applicable to antenna characteristics requested for the present invention. Calculation is performed to compute the filling amount based on a sintered body's value. The sheet thickness can be adjusted to 0.1 through 4 mm. Approximately 1 mm is preferable for the antenna design. A mill roll can be used for sheeting. In addition, the other methods such as a press and a doctor blade can be used.

The insulative material's conductivity need not always be zero. This applies to all the above-mentioned embodiments. Even non-zero conductivity causes no hindrance to embodiment of the present invention only when the insulative material hardly indicates the feature as a conductor. As a specific embodiment of the present invention, the ferrite or the ferrite complex has the electric resistivity of approximately 103 through 1014 Ωcm. While these values are higher than the metal's electric resistivity (approximately 10 through 7 Ωcm), the values vary with materials.

There has been described in detail the present invention with reference to the specific embodiment. It is to be distinctly understood by those skilled in the art that various changes and modifications and substitutions may be made in the embodiment without departing from the spirit and scope of the present invention. That is, the present invention has been disclosed as an example. The contents of this specification should not be interpreted restrictively. The appended claims should be taken into consideration for evaluation of the gist of the present invention.

What is claimed is:

1. A flat-type antenna apparatus which has a radiating conductor and a reference conductor disposed opposite to each other and performs feeding between said radiating conductor and said reference conductor at a position offset from a center of said radiating conductor center, said antenna comprising:

an insulative material layer which has relative magnetic permeability greater than 1 and less than or equal to 10 and is placed in a gap between said radiating conductor and said reference conductor; and a short-circuiting conductor which is disposed at a position to suppress unintended excitation and enables electric conduction between said radiating conductor and said reference conductor, wherein said insulative material layer comprises hexagonal ferrite.

2. The antenna apparatus according to claim 1, wherein said insulative material layer is made of an oxide magnetic material comprising a Y-type ferrite compound represented by general formula $Ba_2Me^1{}_2Fe_{12}O_{22}$ (where $Me^1$ is appropriately selected from one or more of $Ni^{2+}$, $Zn^{2+}$, $Mn^{2+}$, $Mg^{2+}$, $Cu^{2+}$, $Fe^{2+}$, and $Co^{2+}$ to adjust composition).

3. The antenna apparatus according to claim 1, wherein said insulative material layer is made of an oxide magnetic material comprising a Z-type ferrite compound represented by general formula $Ba_3Me^1{}_2Fe_{24}O_{41}$ (where $Me^1$ is appropriately selected from one or more of $Ni^{2+}$, $Zn^{2+}$, $Mn^{2+}$, $Mg^{2+}$, $Cu^{2+}$, $Fe^{2+}$, and $Co^{2+}$ to adjust composition).

4. The antenna apparatus according to claim 1, wherein said insulative material layer is made of an oxide magnetic material comprising an M-type ferrite compound represented by general formula $BaMe^2{}_xFe_{(12-x)}O_{19}$ (where $Me^2$ is appropriately selected from one or more of $Al^{3+}$, $Cr^{3+}$, $Sc^{3+}$, and $In^{3+}$ to adjust composition, or is a mixture of the same amount of($Ti^{4+}$, $Sn^{4+}$, $Zn^{4+}$) and $Me^1$).

5. The antenna apparatus according to claim 1, wherein said insulative material layer is made of oxide magnetic materials as pulverized materials and is complexed with resin to form a resin complex.

6. A flat-type antenna apparatus which has a radiating conductor and a reference conductor disposed opposite to each other and performs feeding between said radiating conductor and said reference conductor at a position offset from a center of said radiating conductor center, said antenna comprising:

an intermediate layer comprising a plurality of layers, the plurality of layers including an insulative material layer and an empty layer in a gap between said radiating conductor and said reference conductor, wherein said insulative material layer has relative permittivity and relative magnetic permeability both greater than 1 and less than or equal to 10, and wherein said insulative material layer comprises hexagonal ferrite.

7. The antenna apparatus according to claim 6, wherein said insulative material layer is made of an oxide magnetic material comprising a Y-type ferrite compound represented by general formula $Ba_2Me^1{}_2Fe_{12}O_{22}$ (where $Me^1$ is appropriately selected from one or more of $Ni^{2+}$, $Zn^{2+}$, $Mn^{2+}$, $Mg^{2+}$, $Cu^{2+}$, $Fe^{2+}$, and $Co^{2+}$ to adjust composition).

8. The antenna apparatus according to claim 6, wherein said insulative material layer is made of an oxide magnetic material comprising a Z-type ferrite compound represented by general formula $Ba_3Me^1{}_2Fe_{24}O_{41}$ (where $Me^1$ is appropriately selected from one or more of $Ni^{2+}$, $Zn^{2+}$, $Mn^{2+}$, $Mg^{2+}$, $Cu^{2+}$, $Fe^{2+}$, and $Co^{2+}$ to adjust composition).

9. The antenna apparatus according to claim 6, wherein said insulative material layer is made of an oxide magnetic material comprising an M-type ferrite compound represented by general formula $BaMe^2{}_xFe_{(l2-x)}O_{l9}$ (where $Me^2$ is appropriately selected from one or more of $Al^{3+}$, $Cr^{3+}$, $Sc^{3+}$, and $In^{3+}$ to adjust composition, or is a mixture of the same amount of($Ti^{4+}$, $Sn^{4+}$, $Zn^{4+}$) and $Me^1$).

10. The antenna apparatus according to claim 6, wherein said insulative material layer is made of oxide magnetic materials as pulverized materials and is complexed with resin to form a resin complex.

* * * * *